United States Patent [19]

Dean et al.

[11] Patent Number: 4,956,024

[45] Date of Patent: Sep. 11, 1990

[54] NON-CONTACTING METHOD OF CLEANING SURFACES WITH A PLANOAR GAS BEARING

[75] Inventors: Robert L. Dean, Castro Valley; Lydia J. Young, Palo Alto; Lee H. Veneklasen, Castro Valley, all of Calif.

[73] Assignee: The Perkin Elmer Corporation, Norwalk, Conn.

[21] Appl. No.: 391,715

[22] Filed: Aug. 7, 1989

Related U.S. Application Data

[63] Continuation of Ser. No. 325,107, Mar. 17, 1989, abandoned, which is a continuation of Ser. No. 142,173, Jan. 11, 1988, abandoned.

[51] Int. Cl.[5] ..... B08B 5/02

[52] U.S. Cl. ..... 134/37; 134/15; 134/25.1; 134/21; 134/36

[58] Field of Search ..... 134/1, 25.1, 31, 21, 134/36, 15, 37

[56] References Cited

U.S. PATENT DOCUMENTS

| | | | |
|---|---|---|---|
| 3,574,261 | 4/1971 | Bailey | 134/37 |
| 3,615,813 | 10/1971 | Clarke et al. | 134/37 |
| 3,775,806 | 12/1973 | Olbrant et al. | 15/306 |
| 4,026,701 | 5/1977 | Till et al. | 15/345 |
| 4,132,567 | 1/1979 | Blackwood | 134/1 |

*Primary Examiner*—Asok Pal

*Attorney, Agent, or Firm*—Thomas P. Murphy; Edwin T. Grimes

[57] ABSTRACT

A non-contact method of cleaning a surface comprising forming a thin gas film (10) of high velocity gas between a surface (14) to be cleaned and a cleaning device (16). The gas film (10), being also a gas bearing, supports the cleaning device (16) and thus forms a self-regulating gap (G) between the surface (14) and the cleaning device (16) so that the cleaning device (16) never contacts the surface (14). The cleaning device (16) comprises a plurality of bores (22) for directing gas onto the surface (14) and an opening (24) for vacuum. In the preferred embodiment, the bores (22) are arranged in a circle and the opening (24) is located centrally of the circle. The thickness of the gas film (10) is determined by the pressure of the incoming gas and vacuum. The creation of turbulence and eddy currents and the use of an ionized gas are enhancements to the cleaning ability of the gas film (10). The method includes moving the cleaning device (16) relative to the surface (14) and vice versa.

20 Claims, 1 Drawing Sheet

NON-CONTACTING METHOD OF CLEANING SURFACES WITH A PLANOAR GAS BEARING

This is a continuation, of application Ser. No. 07/325,107, filed 3/17/89, which is a continuation of application Ser. No. 142,173, filed 1/11/1988, now both abandoned.

BACKGROUND OF THE INVENTION

This invention is directed to a non-contacting method of cleaning surfaces by removing small particulate matter, on the order of a few microns, therefrom.

In the manufacture of semiconductor integrated circuits in which a semiconductor substrate is subjected to various lithographic processes, it is necessary that the substrate surface be kept as clean as possible to minimize the number of defects in the final product and, it is also necessary that the methods of cleaning are not destructive to the substrate surface in any way. This invention provides a simple, non-contacting and effective way to clean particulates of a size as low as 1 or 2 microns from these substrate surfaces.

While this invention will be described in connection with cleaning of semiconductor substrate surfaces, it is understood that this invention may be used wherever it is necessary to remove small particulates from a surface.

It is therefore a primary object of this invention to provide a non-contacting method of removing very small particulate material from surfaces.

SUMMARY OF THE INVENTION

The method which accomplishes the foregoing object involves the formation of a thin film of high velocity gas between the surface to be cleaned and a cleaning device. The gas film, being also a gas bearing, supports the cleaning device and thus forms a self-regulating gap between the cleaning device and the surface so that the cleaning device itself never contacts the surface to be cleaned. The cleaning device comprises a plurality of bores for directing gas onto the surface and an opening for vacuum. Preferably the bores are arranged in a circle and the opening for vacuum is located centrally thereof. The gas film thickness is a function of incoming gas pressure and vacuum. Embodiments of the invention include creating areas of turbulence and eddy currents for aiding in the particulate removal. These areas are created by forming pockets in the cleaning device to disturb the flow of gas. The method includes the use of ionized gas and moving the cleaning device relative to the surface or moving the surface relative to the cleaning device.

It is recognized that there is prior art showing the combination of air pressure and vacuum but this prior art does not utilize this combination to create a planar gas type bearing having film thicknesses and high velocity flows which can dislodge and remove very small (1 or 2 micron) particulates. A typical example of the prior art is shown in the patents to Till et al U.S. Pat. No. 4,026,701 which deals with cleaning the imaging surface of an electrostatographic imaging member with gaps on the order of 0.003 to about 0.015 inches to remove particles on the order of 0.003 to 0.010 inches. These cleaning devices operate in totally different environments, i.e., paper handling and printing, where the particles removed are much larger than the particles removed by this invention.

DETAILED DESCRIPTION

Figure 1:
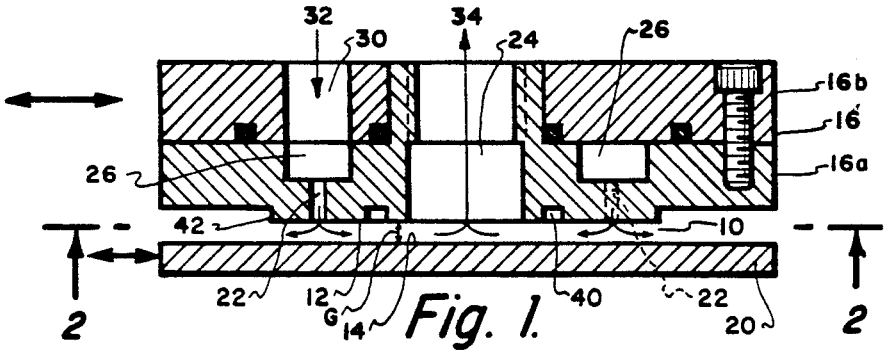
FIG. 1 is an elevational cross-sectional view of one embodiment of the cleaning device shown spaced from a surface to be cleaned and showing the flow of gases across the surface.

As illustrated in the drawings, a gas film 10 is formed between adjacent surfaces 12 and 14 which also forms a gas bearing to space the surface 12 of a cleaning device 16 from the surface 14 of a substrate 20. This space is also denoted in the drawing as gap G. The cleaning device is often referred to as a "puck", and by adjusting the gas pressure appropriately, a small gap G, on the order of 20 to 50 microns, and hence a high velocity flow of gas can be achieved. This high velocity flow of gas removes small particulates, on the order of a few microns, from the surface 14 and also provides a non-contacting method of cleaning the surface 14.

Figure 2:
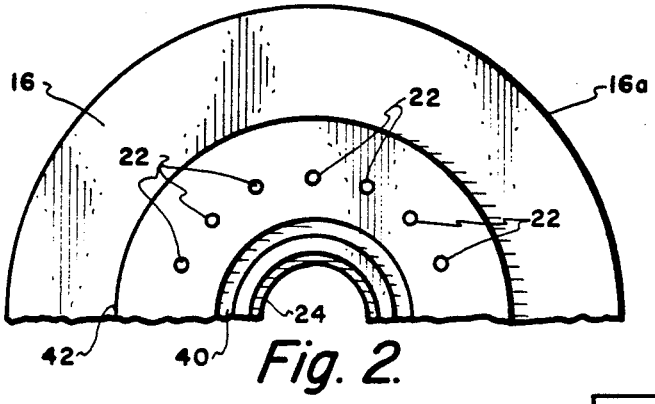
FIG. 2 is a bottom view of the cleaning device, taken along line 2—2 of FIG. 1, and looking in the direction of arrows and showing a plurality of bores for the flow of pressurized gas and a central opening for vacuum.

In FIGS. 1 and 2 it can be seen that the puck 16 comprises a circular body with a plurality of bores 22 arranged preferably in a circle as shown (although other geometries are feasible such as an oval, straight line, etc) about a centrally located larger opening 24. The bores 22 are connected by a circular conduit 26 and a bore 30 to a source of gas under pressure illustrated as a block diagram 32 and the central opening 24 is connected to a vacuum pump 34 also illustrated as a block diagram; both being shown in FIG. 3. The bores 22 are oriented to direct pressurized gas onto the surface 14 and the opening 24 is oriented to remove gas and particulate matter in the area of the center of the surface 12. In the embodiment illustrated, the puck is in two pieces **16*a* and 16*b* for manufacturing purposes and are suitably coupled together, with the conduit 26 and bore 30** for the flow of pressurized gas being formed by and between the two pieces.

The size of the gap G is self regulating and is determined by the gas pressure of about 60 psi and a vacuum about 1 to 10 Torr. With such values and with the bores 22 being about 0.010 inches in diameter, the resulting thickness of gap G lies between 20 and 50 microns providing the correct conditions to remove particles as low as 1 or 2 microns with high efficiency.

Figure 3:
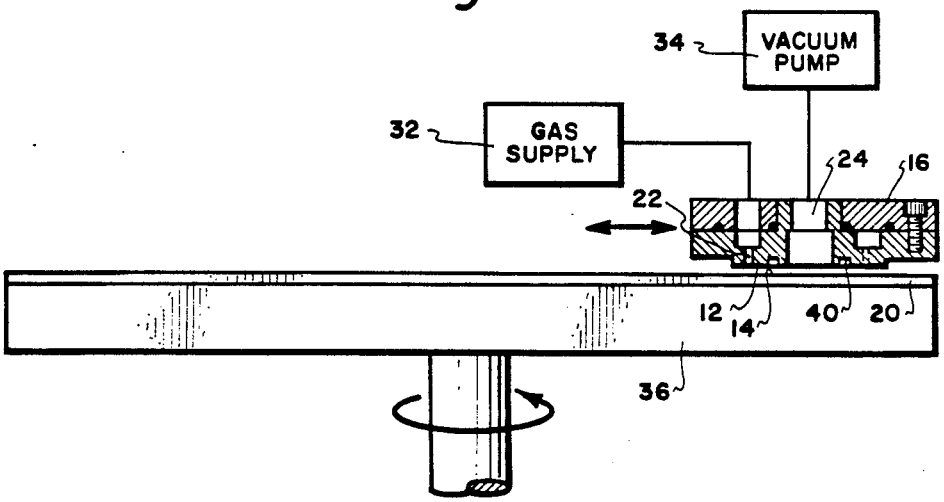
FIG. 3 illustrates the cleaning head spaced relative to a rotating vacuum chuck which is holding a semiconductor substrate to be cleaned.
Figure 4:
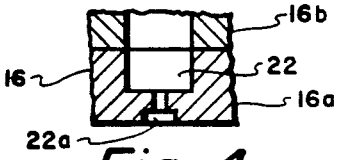
FIG. 4 is a partial cross-sectional view, enlarged over FIGS. 1–3 showing a counterbore in one bore of the cleaning device as an alternative embodiment.

It is understood that to clean an entire surface, the cleaning device 16 is movable relative to the surface 14, and vice versa. FIG. 3 shows one way of cleaning the surface 14 by mounting the substrate 20 on a revolving vacuum chuck 36 and moving the cleaning device radially to clean the entire surface 14.

To enhance the cleaning ability of the gas film, the puck surface 12 is provided with a circular relief groove 40 of about 0.04 inches in depth surrounding the opening 24 and an outer ledge 42 of about the same size. The given depth is only by way of example and other depth values are feasible as will be apparent to those skilled in the art. These create turbulence and eddy currents in the high velocity flow of gas to disturb and remove the small particulates.

In another embodiment, further turbulence and eddy currents in the high velocity flow are created by providing the bores 22 with counterbores 22*a* of about 0.001 to 0.002 inches in depth. The given depth is only by way of example and other depth values are feasible as will be apparent to those skilled in the art.

Finally, if desired, the removal of small particulate matter can further be enhanced by the use of an ionized gas from the source 32.

It will be apparent to those skilled in the art that what makes this invention unique is the very small gap which causes removal of very small particles and that there are many other uses for this invention, such as cleaning flat optical surfaces or optical surfaces having a radius of curvature much larger than the puck dimensions of a few inches.

We claim:

1. A method of cleaning very small particulates, on the order of 1 or 2 microns, from a surface, comprising the steps of:

forming a thin gas film on said surface between a cleaning device and said surface by impinging pressurized gas on said surface, said gas film being planar and having the thickness in the order of 20 to 30 microns and providing a high velocity gas flow between said cleaning device and said surface, and moving said film across said surface.

2. The method as claimed in claim 1 further including the step of ionizing said gas film.

3. The method as claimed in claim 1 including the step of further providing a source of vacuum acting in cooperation with said gas film.

4. The method as claimed in claim 3 further including the step of ionizing said gas film.

5. The method as claimed in claim 1 wherein said source of vacuum is in the center of said gas film.

6. The method as claimed in claim 5 further including the step of ionizing said gas film.

7. The method as claimed in claim 5 including the step of creating said gas film by impinging gas in an arrangement surrounding a centrally located vacuum area.

8. The method as claimed in claim 7 further including the step of ionizing said gas film.

9. The method as claimed in claim 7 wherein said arrangement of impinging gas is circular.

10. The method as claimed in claim 9 further including the step of ionizing said gas film.

11. The method as claimed in claim 7 further including the step of forming areas of turbulence between said vacuum area and said arrangement of impinging gas.

12. The method as claimed in claim 11 further including the step of ionizing said gas film.

13. The method as claimed in claim 7 further including the step of forming areas of turbulence in said gas film outside the area between said arrangement of impinging gas.

14. The method as claimed in claim 13 further including the step of ionizing said gas film.

15. A non-contacting method of removing small particles in the order of 1 to 2 microns in size from a surface comprising the steps of:

providing a puck and positioning same near said surface, forming a planar gas film on said surface by directing pressurized gas through said puck with sufficient pressure to form a gas bearing for supporting said puck on said surface and separating said puck from said surface by a gap size of 20 to 50 microns, and moving said film across said surface.

16. The method as claimed in claim 15 including the steps of ionizing said gas film.

17. The method as claimed in claim 15 further including the step of providing a centrally located vacuum area in said film and forming areas of turbulence between said vacuum area and said gas film.

18. The method as claimed in claim 17 including the step of ionizing said gas film.

19. The method as claimed in claim 15 further including the step of forming areas of turbulence outside the area of said gas film.

20. The method as claimed in claim 19 further including the step of ionizing said gas film.

* * * * *